US007627999B2

(12) United States Patent
Latanision

(10) Patent No.: US 7,627,999 B2
(45) Date of Patent: Dec. 8, 2009

(54) PREFABRICATED FIXTURE PROTECTION COVER AND ASSEMBLY AND METHOD OF USE THEREOF

(75) Inventor: David A. Latanision, Landisville, PA (US)

(73) Assignee: Specialty Products & Insulation, Lancaster, PA (US)

( * ) Notice: Subject to any disclaimer, the term of this patent is extended or adjusted under 35 U.S.C. 154(b) by 699 days.

(21) Appl. No.: 11/366,691

(22) Filed: Mar. 2, 2006

(65) Prior Publication Data

US 2007/0204536 A1 Sep. 6, 2007

(51) Int. Cl.
*E04B 1/76* (2006.01)
*F21S 8/04* (2006.01)

(52) U.S. Cl. ..... 52/407.4; 52/28; 362/147

(58) Field of Classification Search ..... 52/28, 52/404.1, 404.2, 407.1, 407.4, 511, 512; 411/458, 482, 487, 439, 930; 362/365, 147, 362/145

See application file for complete search history.

(56) References Cited

U.S. PATENT DOCUMENTS 3,019,864 A * 2/1962 Lester ..... 52/407.1
3,031,044 A * 4/1962 Stitt et al. ..... 52/508
3,071,827 A * 1/1963 Van Buren, Jr. ..... 52/511
3,415,018 A 12/1968 Sutter
3,557,840 A * 1/1971 Maybee ..... 138/149
3,908,327 A * 9/1975 Quigg ..... 52/834
4,210,070 A 7/1980 Tatum et al.
4,237,671 A 12/1980 Munson
4,288,951 A * 9/1981 Carlson et al. ..... 52/94
4,675,225 A * 6/1987 Cutler ..... 428/74
5,299,403 A * 4/1994 Fentz ..... 52/404.2
5,345,729 A 9/1994 Prahst et al.
6,079,856 A 6/2000 Prestier
6,105,334 A * 8/2000 Monson et al. ..... 52/741.3
6,286,980 B1 9/2001 Meyer
6,409,445 B1 * 6/2002 Beale et al. ..... 411/439
6,860,617 B2 3/2005 Fiene
6,872,885 B1 * 3/2005 Newbold, Jr. ..... 174/58
2002/0184841 A1 * 12/2002 Diamond ..... 52/203

* cited by examiner

*Primary Examiner*—Robert J Canfield
*Assistant Examiner*—Christine T Cajilig
(74) *Attorney, Agent, or Firm*—Barley Snyder LLC

(57) ABSTRACT

A prefabricated fixture protection cover for attachment to a recessed electrical fixture mounted on a grid system comprises a panel having grooving dividing the panel into a top wall, a first wall, and a second wall. The first and second walls are foldable about the grooving to a position substantially perpendicular to the top wall. At least one attachment member includes a pin and a base. The pin has a piercing end that impales a bottom surface of the top wall of the panel to secure the panel in a fixed position relative to the recessed electrical fixture.

28 Claims, 4 Drawing Sheets

PREFABRICATED FIXTURE PROTECTION COVER AND ASSEMBLY AND METHOD OF USE THEREOF

FIELD OF THE INVENTION

The invention relates to a prefabricated fixture protection cover and assembly and method of use thereof.

BACKGROUND OF THE INVENTION

In fire rated ceilings, recessed electrical fixtures, such as light fixtures, speaker systems, electrical systems, heating, ventilating, and air conditioning (HVAC) diffusers, etc., are required by UL (Underwriters Laboratory Inc.) listed designs to be covered or enclosed with fire rated materials. These materials must not only be fire retardant, but must also be provided with a means to ensure sufficient ventilation of any heat generated by the recessed electrical fixture. It is known to cut a plurality of panels from a fire rated material and assemble the panels around the recessed electrical fixture on site. The panels are cut and/or arranged such that the panels cover the recessed electrical fixture while still providing sufficient ventilation.

Cutting and fabricating the panels in the field, however, is time consuming and causes material waste. It is also difficult to properly cut and/or arrange the panels such that sufficient fire protection and ventilation is ensured. It is therefore desirable to develop a cover for recessed electrical fixtures wherein the cover can be quickly and easily installed and proper fire protection and ventilation can be ensured. It is further desirable to develop a cover with enhanced acoustical separation performance and enhanced thermal insulation properties.

BRIEF SUMMARY OF THE INVENTION

The invention provides a prefabricated fixture protection cover for attachment to a recessed electrical fixture mounted on a grid system comprising a panel having grooving dividing the panel into a top wall, a first wall, and a second wall. The first and second walls are foldable about the grooving to a position substantially perpendicular to the top wall. At least one attachment member includes a pin and a base. The pin has a piercing end that impales a bottom surface of the top wall of the panel to secure the panel in a fixed position relative to the recessed electrical fixture.

The invention further provides a prefabricated fixture protection cover assembly comprising a grid system, a recessed electrical fixture mounted on the grid system, and a panel. The panel has grooving dividing the panel into a top wall, a first wall, and a second wall. The first and second walls are foldable about the grooving to a position substantially perpendicular to the top wall. At least one attachment member includes a pin and a base. The pin has a piercing end that impales a bottom surface of the top wall of the panel to secure the panel in a fixed position relative to the recessed electrical fixture.

The invention still further provides a method of assembling a prefabricated fixture protection cover. The method comprises the steps of attaching at least one attachment member to a recessed electrical fixture mounted on a grid system; impaling a top wall of a panel into a pin extending from the attachment member until the panel engages a stopper to secure the panel in a fixed position relative to the recessed electrical fixture; folding first and second side walls about grooving on the panel into a position substantially perpendicular to the top wall of the panel; and tucking ends of the first and second side walls into the grid system.

DETAILED DESCRIPTION OF THE INVENTION

Figure 1:
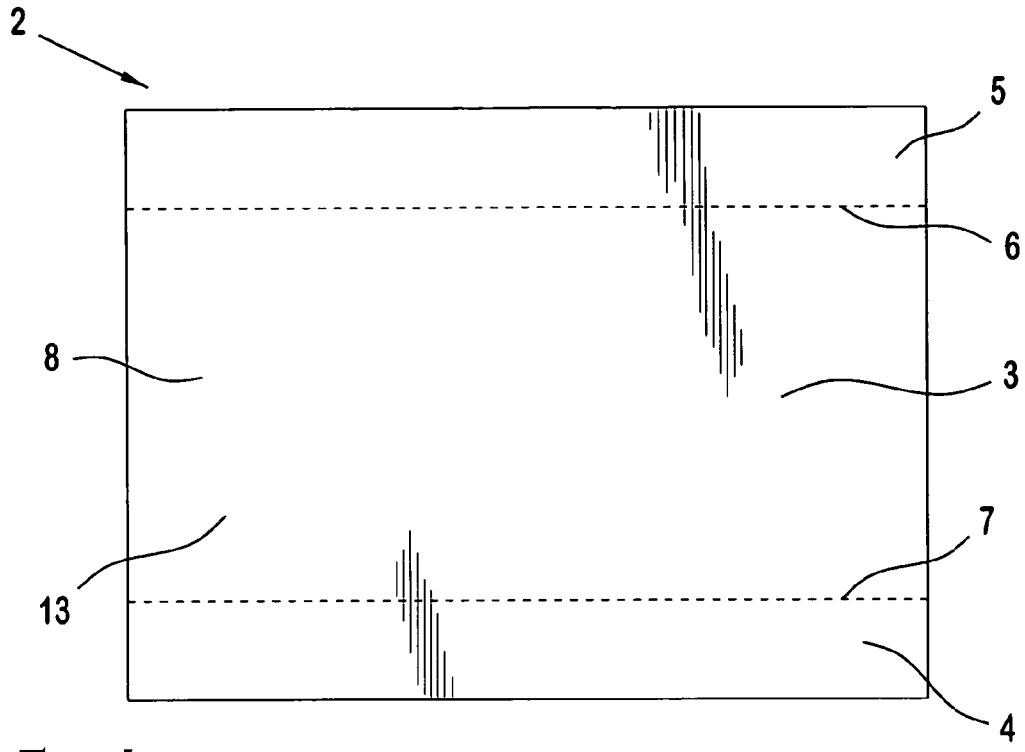
FIG. 1 is a plan view of a panel of a prefabricated fixture protection cover according to the invention.
Figure 2:
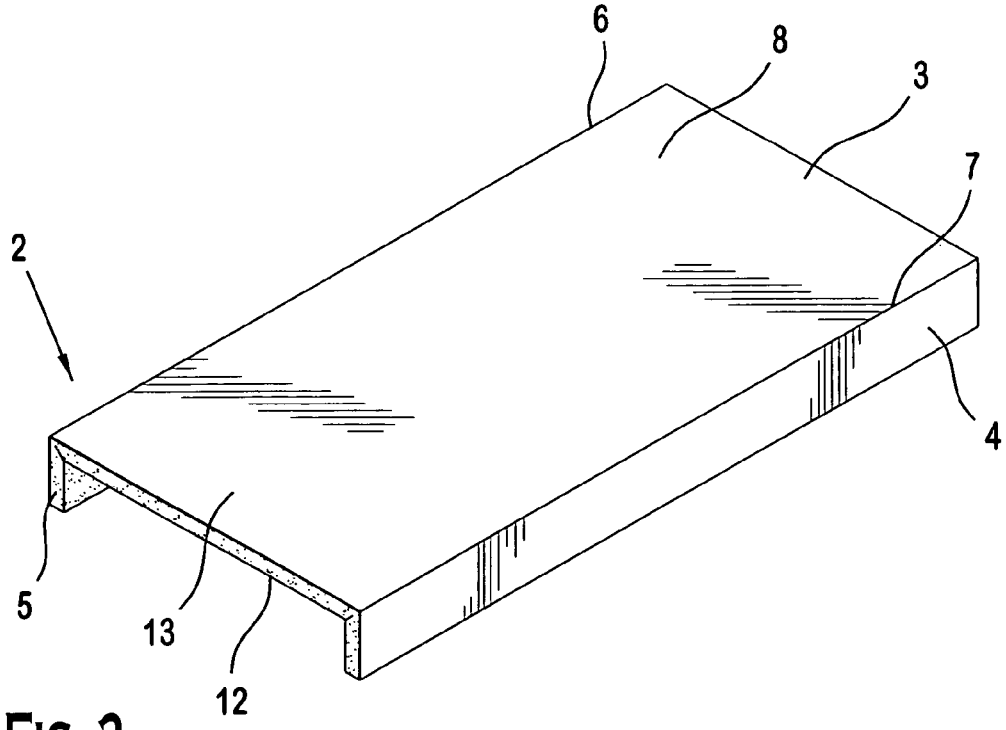
FIG. 2 is a perspective view of the panel of the prefabricated fixture protection cover.

FIGS. 1-6 show a prefabricated fixture protection cover 1 according to the invention. The prefabricated fixture protection cover 1 includes a panel 2, locking members 9, and attachment members 14. As shown in FIG. 1, the panel 2 is substantially flat and may be formed, for example, from a high temperature, noncombustible, rigid mineral fiber board, such as a mineral wool board. The panel 2 may alternatively be formed, for example, from a fiberglass batt, fiberglass board, ceramic fiber batt, ceramic fiber board, etc. The panel 2 may have a thickness, for example, of approximately 1.25 inches. The panel 2 has a bottom surface 12 and a top surface 13. The top surface 13 of the panel 2 is provided with a facing 8. The facing 8 may be, for example, an intumescent material or other coating or a facing material, such as foil-scrim-kraft (FSK), aluminum, stainless steel, fiberglass scrim, reinforced foil, etc. The facing 8 may be attached, for example, to the top surface 13 with an adhesive. The panel 2 has grooving 6, 7 extending substantially parallel to a longitudinal axis thereof. The grooving 6, 7 may be formed, for example, as V-shaped grooves, kerfing, scores, etc. The grooving 6, 7 is formed such that the panel 2 can be folded about the grooving 6, 7 to form an integral multi-sided cover having a top wall 3 and first and second side walls 4, 5, respectively, as shown in FIG. 2. The first and second side walls 4, 5 extend substantially perpendicular to the top wall 3.

Figure 5:
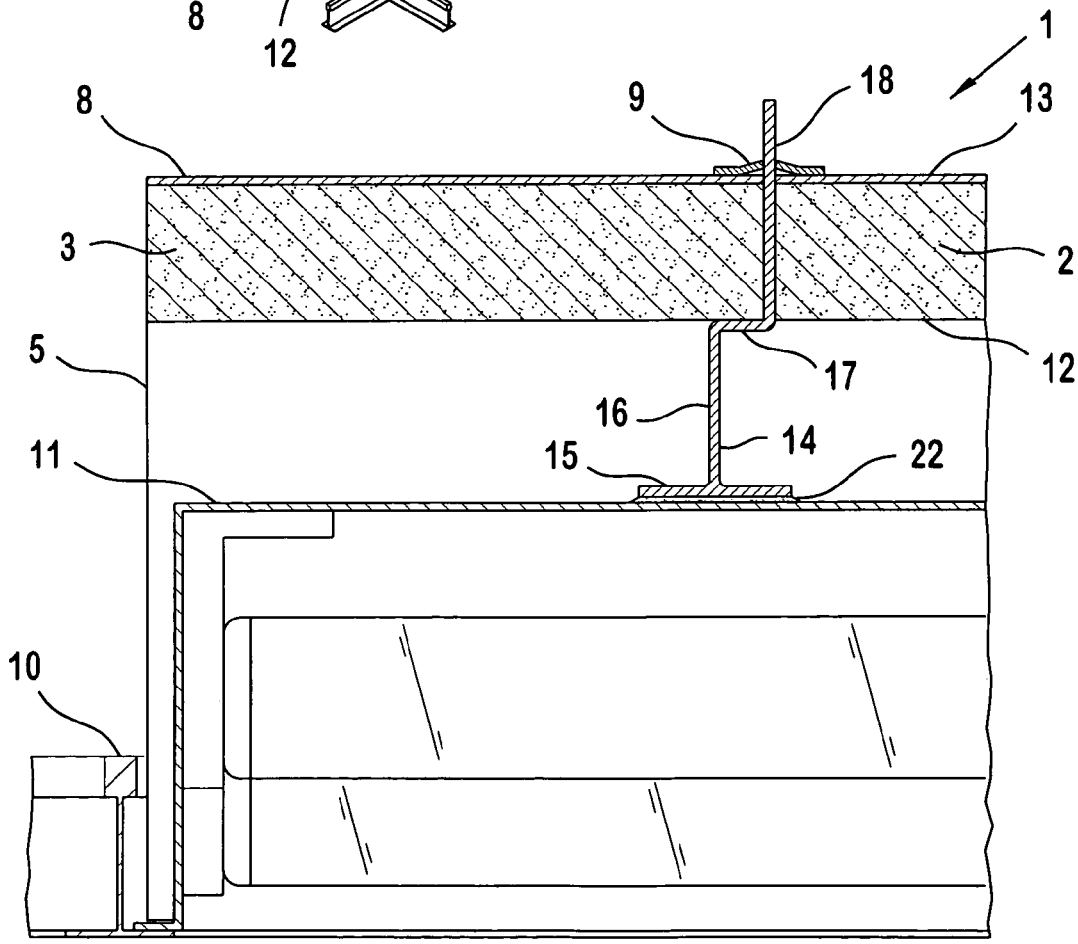
FIG. 5 is a sectional view of FIG. 4.
Figure 6:
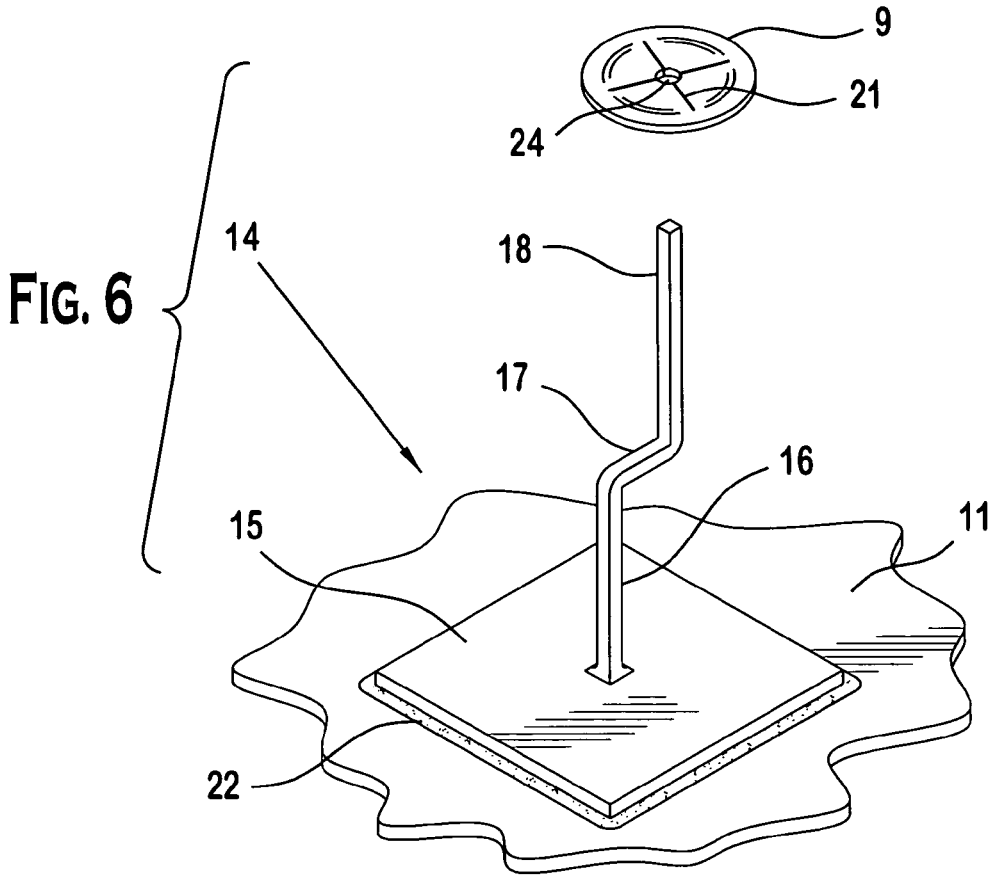
FIG. 6 is a perspective view of an attachment member and locking member.

As shown in FIGS. 5-6, the attachment members 14 include a base 15 and a pin 16. The base 15 has a bottom surface provided with an attachment mechanism 22, such as an adhesive strip. It will be appreciated by those skilled in the art, however, that other known attachment mechanisms may be used. The pin 16 is substantially S-shaped and extends substantially perpendicular to the base 15. The pin 16 includes a stopper 17 and a piercing end 18. The stopper 17 is positioned proximate the piercing end 18 and is integrally formed with the pin 16. The stopper 17 may be, for example, a crimped portion, an offset, a partial sleeve, a locking washer, etc. The attachment members 14 may be formed, for example, from a substantially rigid material such as plastic, metal, wood, ceramic, etc.

As shown in FIGS. 5-6, the locking members 9 are formed as washers and are provided with a plurality of substantially diagonal slits 21 extending from a centrally located opening 24. The locking members 9 may be formed, for example, from a galvanized steel sheet. It will be appreciated by those skilled in the art that although the locking members 9 shown in the illustrated embodiment are commonly known as compression washers, that the locking members 9 are not limited to thereto and that other known locking members may be used.

An example of the assembly of the prefabricated fixture protection cover 1 to a recessed electrical fixture 11 mounted on a grid system 10 will now be described with reference to FIGS. 3-5. It will be appreciated by those skilled in the art that the recessed electrical fixture 11 may be a light fixture, speaker system, HVAC diffuser, electrical unit, etc. It will also be appreciated by those skilled in the art that the grid system 10 may include any traditional ceiling fixture framing.

Figure 3:
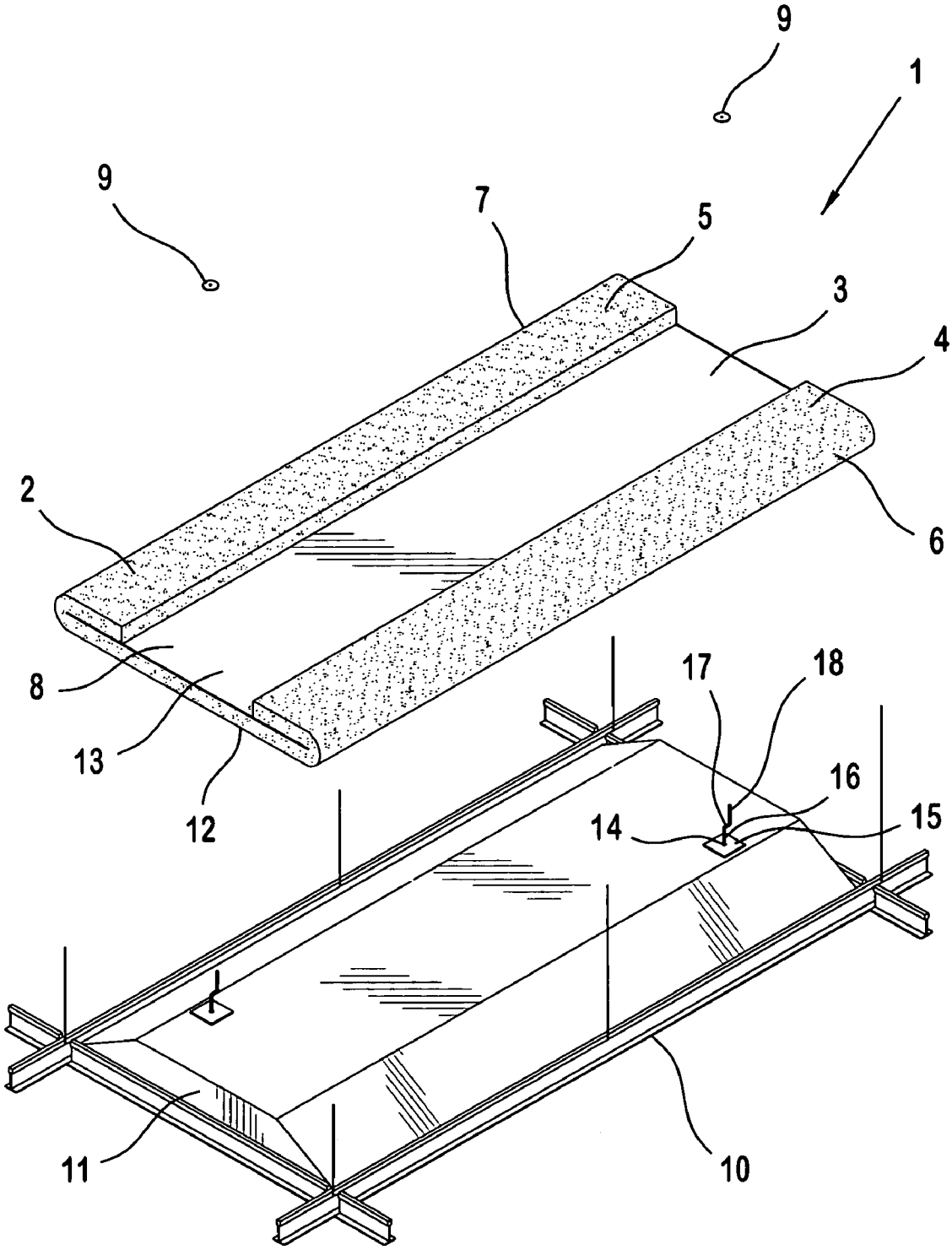
FIG. 3 is a perspective view of the prefabricated fixture protection cover during assembly to a light recessed electrical fixture.

As shown in FIG. 3, the base 15 of the attachment members 14 are attached to ends of the recessed electrical fixture 11 by the attachment mechanism 22. The first and second side walls 4, 5 of the panel 2 are folded toward the top surface 13 of the top wall 3 until the facing 8 on the first and second side walls 4, 5 is positioned adjacent to the facing 8 on the top wall 3. In this position, the first and second side walls 4, 5 are positioned substantially parallel to the top wall 3. The panel 2 is then slid through the grid system 10 until the bottom surface 12 of the top wall 3 of the panel 2 is positioned over the recessed electrical fixture 11 and the attachment members 14. The first and second side walls 4, 5 are then folded away from the top wall 3 and are positioned substantially perpendicular to the top wall 3.

Figure 4:
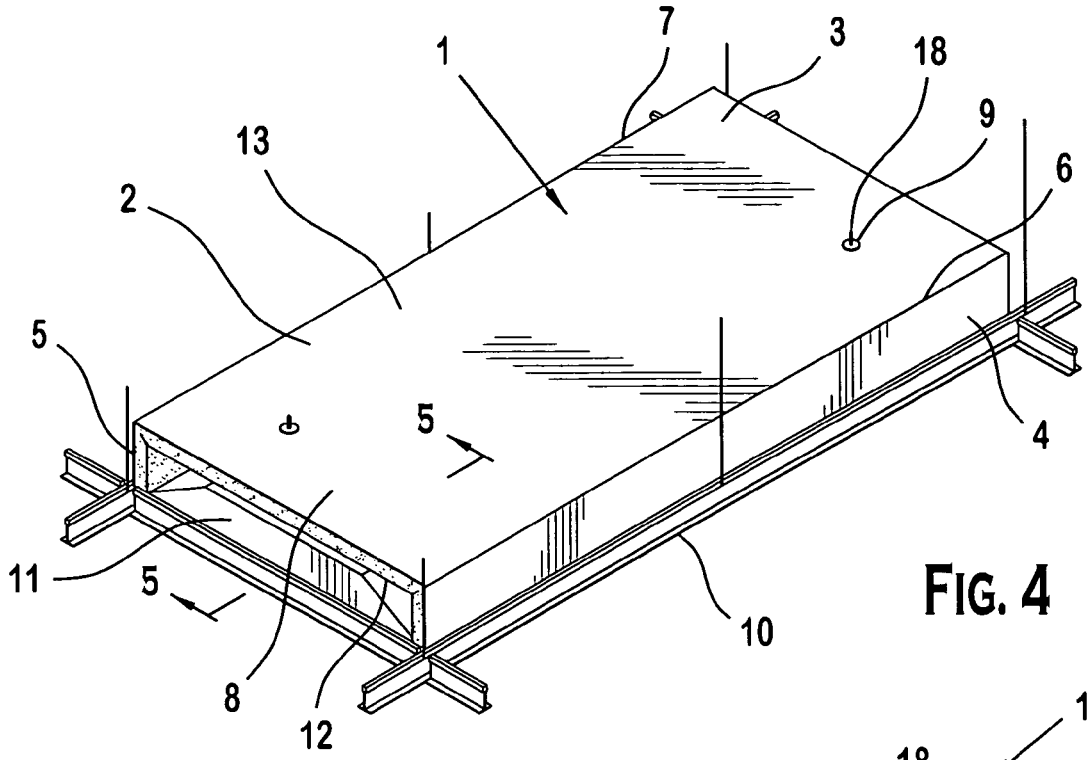
FIG. 4 is a perspective view of the prefabricated fixture protection cover assembled to the light recessed electrical fixture.

As shown in FIGS. 4-5, the bottom surface 12 of the top wall 3 of the panel 2 is impaled into the piercing end 18 of the pins 16 until the panel 2 reaches the stopper 17. The stopper 17 thereby prevents the downward movement of the panel 2 on the pin 16. The locking members 9 are positioned on the piercing end 18 of the pins 16 by inserting the piercing end 18 into the aperture 24. The panel 2 is thereby secured between the stopper 17 and the locking member 9. The first and second side walls 4, 5 are attached or tucked into the grid system 10.

Figure 7:
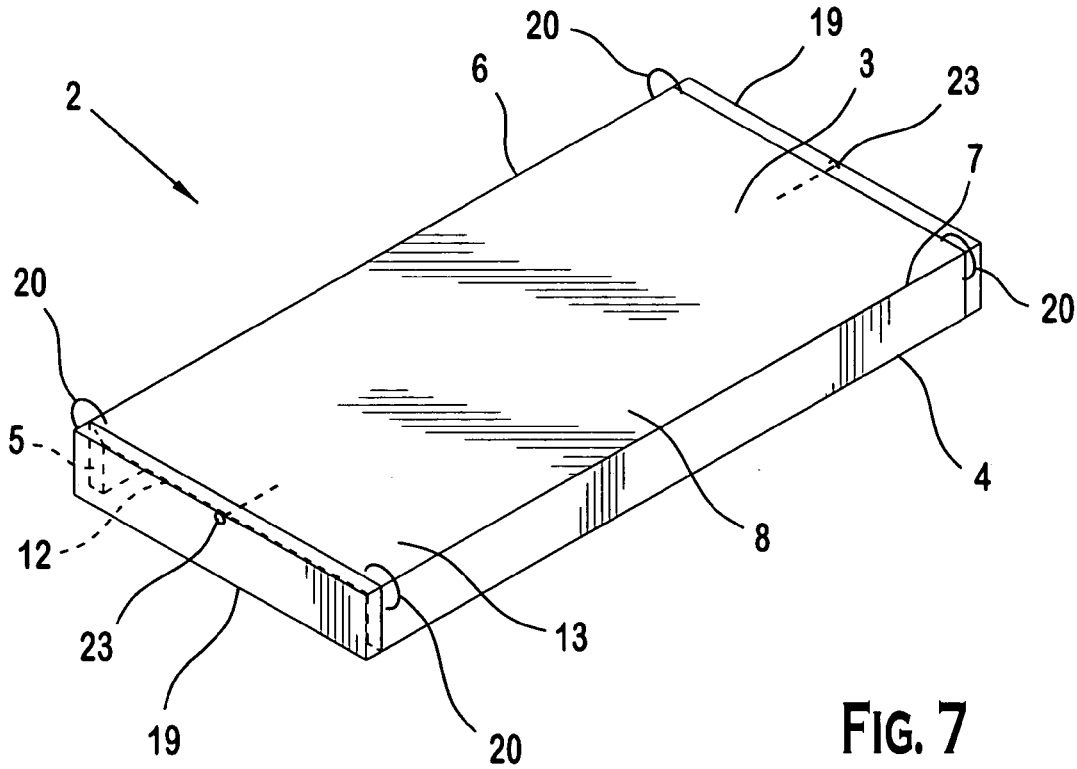
FIG. 7 is a perspective view of an alternate embodiment of the panel of the prefabricated fixture protection cover.

FIG. 7 shows an alternate embodiment of the prefabricated fixture protection cover 1. As shown in FIG. 6, the panel 2 of the prefabricated fixture protection cover 1 may additionally be provided with end walls 19. The end walls 19 are formed, for example, from a high temperature, noncombustible, rigid mineral fiber board, such as a mineral wool board. The panel 2 may alternatively be formed, for example, from a fiberglass batt, fiberglass board, ceramic fiber batt, ceramic fiber board, etc. The end walls 19 are attached to the panel 2 by first fixing members 20 and second fixing members 23 such that the end walls 19 extend substantially perpendicular to the top wall 3. The first fixing members 20 are substantially C-shaped and secure corners of the end walls 19 to the first and second side walls 4, 5 of the panel 2. The second fixing members 23 are substantially straight and secure a top of the end walls 19 to the top wall 3 of the panel 2. The first and second fixing members 20, 23 may, for example, be C-shaped pins, straight pins, staples, screws, preformed clips, etc. It will be appreciated by those skilled in the art that alternatively only one of the end walls 19 could be provided on the panel 2. Additionally, the end walls 19 may be integrally formed with the panel 2 in the same manner as the side walls 4, 5.

Because the panel 2 of the prefabricated fixture protection cover 1 is of one piece construction, the panel 2 of the prefabricated fixture protection cover 1 is quick and easy to install in comparison to conventional covers that require field cutting and onsite fabrication. Additionally, the panel 2 is made of a material that is lightweight, durable, and can easily be slit to provide additional venting or to accommodate recessed electrical fixture suspension wires and/or power connections. The combination of the stopper 17 integrally formed on the pin 16 and the locking member 9 additionally ensure that the panel 2 is securely attached to the recessed electrical fixture 11 and that air space between the recessed electrical fixture 11 and the panel 2 is maintained. Further, the prefabricated fixture protection cover 1 meets UL fire listed designs.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A prefabricated fixture protection cover for attachment to a recessed electrical fixture mounted on a grid system, the prefabricated fixture protection cover comprising:

a panel having grooving dividing the panel into a top wall, a first wall, and a second wall, the first and second walls being foldable about the grooving to a position substantially perpendicular to the top wall;

and at least one attachment member having a pin and a base adapted to rest upon the fixture such that the attachment member forms a space above the base between the fixture and the panel, the pin having a piercing end that impales a bottom surface of the top wall of the panel to secure the panel in a fixed position relative to the recessed electrical fixture.

2. The prefabricated fixture protection cover of claim 1, wherein the panel is formed from a mineral fiber board.

3. The prefabricated fixture protection cover of claim 2, wherein a top surface of the panel is provided with a foil-skim-kraft facing.

4. The prefabricated fixture protection cover of claim 1, wherein the pin is substantially S-shaped.

5. The prefabricated fixture protection cover of claim 1, wherein the panel includes at least one end wall extending substantially perpendicular to the top wall.

6. The prefabricated fixture protection cover of claim 1, wherein the pin includes a stopper arranged proximate the piercing end that limits the downward movement of the panel.

7. The prefabricated fixture protection cover of claim 6, further comprising a locking member attached to the pin, the panel being positioned between the stopper and the locking member.

8. The prefabricated fixture protection cover of claim 6, wherein the stopper is an offset.

9. An assembly of a prefabricated fixture protection cover, comprising:

a grid system;

a recessed electrical fixture mounted on the grid system; and a panel having grooving dividing the panel into a top wall, a first wall, and a second wall, the first and second walls being foldable about the grooving to a position substantially perpendicular to the top wall, and at least one attachment member having a pin and a base, adapted to rest upon the fixture such that the attachment member forms a space above the base between the fixture and the panel, the pin having a piercing end that impales a bottom surface of the top wall of the panel to secure the panel in a fixed position relative to the recessed electrical fixture.

10. The assembly of claim 9, wherein the panel is formed from a mineral fiber board.

11. The assembly of claim 10, wherein a top surface of the panel is provided with a foil-skim kraft facing.

12. The assembly of claim 9, wherein the pin is substantially S-shaped.

13. The assembly of claim 12, wherein the base is attached to the recessed electrical fixture by an adhesive strip.

14. The assembly of claim 9, wherein the panel includes at least one end wall extending substantially perpendicular to the top wall.

15. The assembly of claim 9, wherein the pin includes a stopper arranged proximate the piercing end that limits the downward movement of the panel.

16. The assembly of claim 15, further comprising a locking member attached to the pin, the panel being positioned between the stopper and the locking member.

17. The assembly of claim 16, wherein the stopper is an offset.

18. The assembly of claim 9, wherein the first and second walls are tucked into the grid system to secure the panel thereto.

19. A method of assembling a prefabricated fixture protection cover, comprising the steps of:

attaching at least one attachment member to a recessed electrical fixture mounted on a grid system;

impaling a top wall of a panel into a pin extending from the attachment member until the panel engages a stopper to secure the panel in a fixed position relative to the recessed electrical fixture;

folding first and second side walls about grooving on the panel into a position substantially perpendicular to the top wall of the panel; and tucking ends of the first and second side walls into the grid system.

20. The method of claim 19, further comprising the step of applying a locking member to the pin so that the panel is positioned between the stopper and the locking member.

21. The method of claim 19, wherein the panel is formed from a mineral fiber board.

22. The method of claim 21, wherein a top surface of the panel is provided with a foil-skim-Kraft facing.

23. A prefabricated fixture protection cover for attachment to a recessed electrical fixture mounted on a grid system, the prefabricated fixture protection cover comprising:

a panel having grooving dividing the panel into a top wall, a first wall, and a second wall, the first and second walls being foldable about the grooving to a position substantially perpendicular to the top wall;

at least one attachment member having a pin, a base adapted to rest upon the fixture, and a stopper, the pin having a piercing end that impales a bottom surface of the top wall of the panel, the stopper arranged proximate the piercing end to limit downward movement of the panel toward the base such that the attachment member secures the panel in a fixed position above the base and spaced from the recessed electrical fixture.

24. The prefabricated fixture protection cover of claim 23, wherein the attachment member further comprises an adhesive.

25. The prefabricated fixture protection cover of claim 23, wherein the panel is formed from a mineral fiber board.

26. The prefabricated fixture protection cover of claim 25, wherein a top surface of the panel is provided with a foil-skim-kraft facing.

27. The prefabricated fixture protection cover of claim 23, wherein the panel includes at least one end wall extending substantially perpendicular to the top wall.

28. The prefabricated fixture protection cover of claim 27, further comprising a locking member attached to the pin, the panel being positioned between the stopper and the locking member.

* * * * *